US005547514A

United States Patent [19]

Ward et al.

[11] Patent Number: 5,547,514

[45] Date of Patent: Aug. 20, 1996

[54] APPARATUS FOR CLEANING SUB-SURFACE ELECTRICAL ENCLOSURES AND THE LIKE

[75] Inventors: Stephen W. Ward; Ray E. Harwood, both of Bakersfield, Calif.

[73] Assignee: Pacific Gas and Electric Company, San Francisco, Calif.

[21] Appl. No.: 314,398

[22] Filed: Sep. 28, 1994

[51] Int. Cl.[6] ..... B08B 9/08

[52] U.S. Cl. ..... 134/22.1; 134/166 R; 134/169 R; 134/104.1

[58] Field of Search ..... 134/166 R, 167 R, 134/169 R, 167 C, 166 C, 104.1, 22.1; 15/320, 321, 304; 141/183, 188; 137/256, 267

[56] References Cited

U.S. PATENT DOCUMENTS

| | | | |
|---|---|---|---|
| 2,004,716 | 6/1935 | Thwaits | 137/267 |
| 2,539,663 | 1/1951 | Hague | 137/267 |
| 2,568,803 | 9/1951 | Guenst | 15/321 X |
| 2,595,743 | 5/1952 | Young | 137/267 X |
| 2,646,817 | 7/1953 | Cox et al. | 137/267 X |
| 2,730,126 | 1/1956 | Jensen | 137/267 X |
| 2,792,014 | 5/1957 | Granberg | 137/267 |
| 3,447,188 | 6/1969 | Maasberg | 15/320 |
| 3,658,589 | 4/1972 | Shaddock | 134/10 |
| 4,054,149 | 10/1977 | Nelson | 134/167 C |
| 4,234,980 | 11/1980 | DiVito et al. | 15/302 |
| 4,280,672 | 7/1981 | Santos | 15/40 |
| 4,322,868 | 4/1982 | Wurster | 15/302 |
| 4,525,277 | 6/1985 | Poulin | 210/601 |
| 4,530,131 | 7/1985 | Zell et al. | 15/321 |
| 4,938,241 | 7/1990 | Tell | 134/167 R |
| 4,961,244 | 10/1990 | Stanfield et al. | 15/321 |
| 5,341,539 | 8/1994 | Sheppard et al. | 15/321 |

FOREIGN PATENT DOCUMENTS

| | | | |
|---|---|---|---|
| 544196 | 7/1957 | Canada | 137/267 |
| 54-129512 | 10/1979 | Japan | 137/267 |
| 1460031 | 12/1976 | United Kingdom . | |

*Primary Examiner*—Frankie L. Stinson
*Attorney, Agent, or Firm*—Burns, Doane, Swecker & Mathis

[57] ABSTRACT

An apparatus mounted on a vehicle frame for cleaning liquids and solids from a sub-surface enclosure. The apparatus comprises a water tank having a drain valve and a feed valve. A water pump is connected to the feed valve that supplies water to a high pressure cleaning device used for loosening waste solids in the sub-surface enclosure. A suction pump connected to a suction hose removes the waste from the sub-surface enclosure and directs it to either of two waste tanks through a valve configuration comprising an inlet valve connected to one waste tank and a second inlet valve connected to the other waste tank. The two inlet valves selectively allow the waste removed from the sub-surface enclosure to enter either the first waste tank, the second waste tank or both. A method for cleaning the sub-surface enclosure is also provided.

3 Claims, 3 Drawing Sheets

APPARATUS FOR CLEANING SUB-SURFACE ELECTRICAL ENCLOSURES AND THE LIKE

BACKGROUND OF THE INVENTION

The present invention relates generally to systems used to clean sub-surface electrical enclosures, such as the type that house transformers. More particularly, the invention concerns an apparatus with a novel tank and valve system that can be used to clean the sub-surface electrical enclosures without having to de-energize the electrical equipment in the enclosure.

The sub-surface electrical enclosures can be concrete, fiberglass, plywood, etc. Most enclosures have a gravel base although some have a concrete base. Typically the enclosure is 40 inches in diameter and up to 7 feet deep. The enclosure may house one of any number of different pieces of equipment, such as transformers, switchers, relays, interrupters, J-boxes, terminal connections, splice boxes, etc. along with a mass of stiff, high voltage cables. All of these are many different sizes.

In the case of a transformer, there generally is only about 6 to 8 inches of clearance between the transformer and the enclosure wall. There is usually 6 to 12 cables winding around the transformer so there is very limited space in the enclosure. The limited space is for air cooling the transformer. Typically, debris, mud, water, etc. drain into the enclosure and become compacted and wedged in the enclosure.

With the prior art method of de-energizing and removing the equipment from the enclosure then flooding the enclosure with thousands of gallons of water and removing the debris and water with a huge vacuum truck, it is too expensive and labor intensive to do normal maintenance clean-up of the enclosures. However, the water, dirt, debris, etc. around the electrical equipment (e.g., a transformer) can cause contamination of the equipment, rusting, cable deterioration, overheating, etc. all leading to failure of the equipment. If a transformer fails it can leak hazardous materials into the enclosure. The normal life expectancy for example a transformer is 20–30 years. However, it is common for a transformer to fail in five or ten years due to overheating and/or corrosion caused by the water, dirt, debris, etc. As a result, the whole life cycle of the initial investment in the equipment can not be realized.

After a failure has occurred, on average, it requires six to twelve hours depending on the enclosure to remove the failed equipment, clean the enclosure, and connect the new equipment. The labor and equipment costs for such a job can run into the tens of thousands of dollars. As well as, the inconvenience to the customer and the losses in revenue from the customer. Therefore, it would be desirable to have an apparatus that could do regular maintenance on sub-surface electrical enclosure without having to de-energize and/or remove the electrical equipment.

SUMMARY OF THE INVENTION

The present invention provides an apparatus for cleaning sub-surface electrical enclosures having all the desirable characteristics discussed above while overcoming the deficiencies of the known prior art devices.

In accordance with this invention, a sub-surface electrical enclosure can be cleaned quickly and efficiently with a portable apparatus comprising a water supply tank connected to a high pressure cleaning device that is used to break-up and semi-liquify debris in the sub-surface enclosure. The portable apparatus has a waste tank attached to a suction hose that is used to draw the debris out of the sub-surface enclosure so that it can be transported to a selected site for proper disposal.

In accordance with one embodiment of the present invention, there is provided an apparatus for cleaning liquids and solids from a sub-surface enclosure, comprising: a frame means; a water tank mounted on the frame means, the water tank having a feed value and a drain valve; a water pump mounted on said frame means to receive water from the water tank and for providing a stream of pressurized feed water to clean the sub-surface enclosure; a high pressure cleaning means in fluid communication with the water pump for supplying water for loosening solids in the sub-surface enclosure; a suction means, separate from the high pressure cleaning means, for removing the liquids and solids from the sub-surface enclosure; a first waste tank mounted on the frame means and being in fluid communication with the suction hose for receiving and holding the liquids and solids removed from the sub-surface enclosure by the suction means, the first waste tank having a first waste liquid drain valve; a second waste tank mounted on the frame means in fluid communication with the suction means for receiving and holding the liquids and solids removed from the sub-surface enclosure by the suction means, the second waste tank having a second waste drain valve; and a waste selection inlet valve in fluid communication with the first waste tank and the second waste tank to selectively allow the liquids and solids to enter either the first waste tank or the second waste tank, or both.

In accordance with another embodiment of the present invention, there is provided an apparatus for cleaning liquids and solids from a sub-surface enclosure, comprising: a vehicle having a frame; a water tank mounted on the frame, the fresh water tank having a feed valve and a drain valve; a water pump mounted on the frame to receive water from the water tank and to provide a stream of pressurized feed water to clean the sub-surface enclosure; a high pressure cleaning device in fluid communication with the water pump for loosening the liquids and solids in the sub-surface enclosure; a suction hose for removing the liquids and solids from the sub-surface enclosure; a first waste tank mounted on said frame and being in fluid communication with the suction hose for receiving and holding the liquids and solids removed from the sub-surface enclosure, the first waste tank having a first waste drain valve; a second waste liquid tank mounted on the frame and being in fluid communication with the suction hose for receiving and holding the liquids and solids removed from the sub-surface enclosure, the second waste tank having a second waste drain valve; a suction pump mounted on the frame for drawing the liquids and solids through the suction hose; a first waste inlet valve in fluid communication with an inlet in the first waste tank; and a second waste inlet valve mounted adjacent to and down stream from the first waste inlet valve and being in fluid communication with an inlet in the second waste tank; said first waste inlet valve and said second waste inlet valve selectively allow the liquids and solids to enter the first waste tank or the second waste liquid tank or both.

In accordance with one of its method aspects, there is provided a method for cleaning liquids and solids from a sub-surface electrical enclosure that may have hazardous materials present, comprising: opening a water feed valve attached to a water tank for supplying water to a water pump to clean the sub-surface electrical enclosure; attaching a high pressure cleaning device to the water pump; starting the water pump; semi-liquefying the solids in the sub-surface electrical enclosure with the high pressure cleaning device to form a slurry; attaching a suction hose to a suction pump to draw the liquids and solids from the sub-surface electrical enclosure; opening a first waste inlet valve in fluid communication with a first waste tank so that liquids and solids can be received in the first waste tank; starting the suction pump; suctioning the liquids and solids from the sub-surface electrical enclosure through the suction hose to the first waste tank; stopping the water pump and the suction pump when the liquids and solids have been removed from the sub-surface electrical enclosure; attaching a clean-out attachment to the suction hose to flush the suction hose, the suction pump, and the first waste inlet valve; connecting the high pressure cleaning device to the clean-out attachment; and running the water pump and the suction pump until the suction hose, the suction pump, and the first waste inlet valve are clean of the liquids and solids.

BRIEF DESCRIPTION OF THE DRAWING

Many objects and advantages of the present invention will be apparent to those skilled in the art when this specification is read in conjunction with the attached drawings wherein like reference numerals are applied to like elements and wherein.

DETAILED DESCRIPTION OF THE PREFERRED EMBODIMENTS

Figure 1:
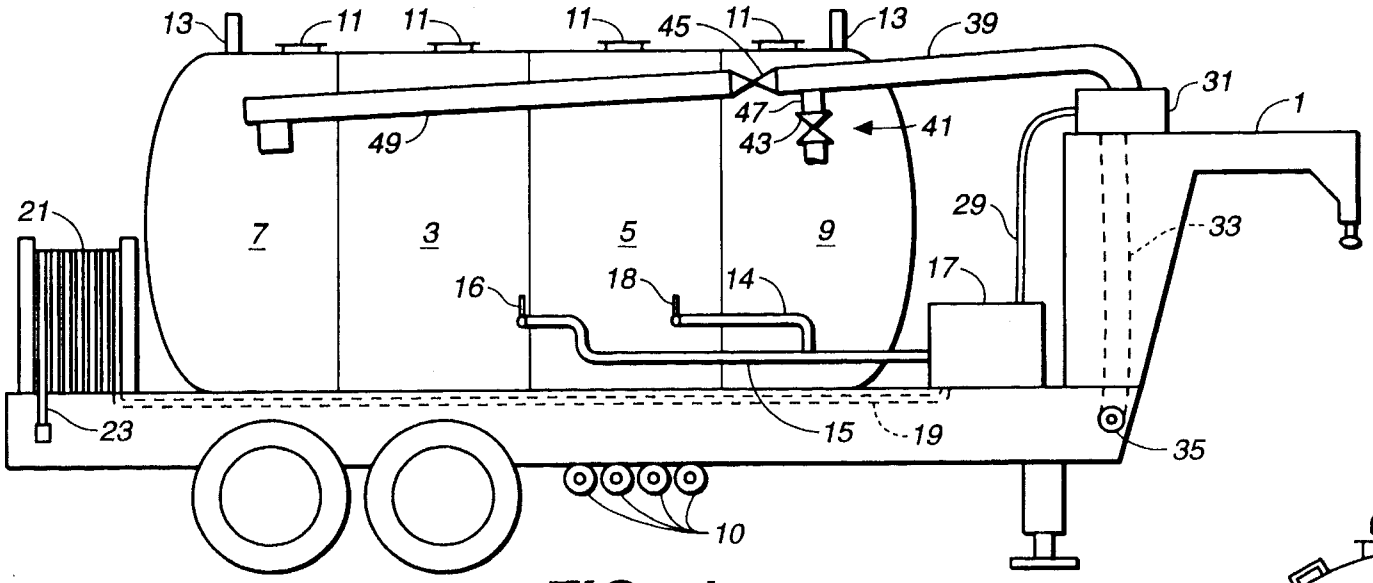
FIG. 1 is a side elevational view of a portable apparatus in accordance with the present invention.
Figure 2:
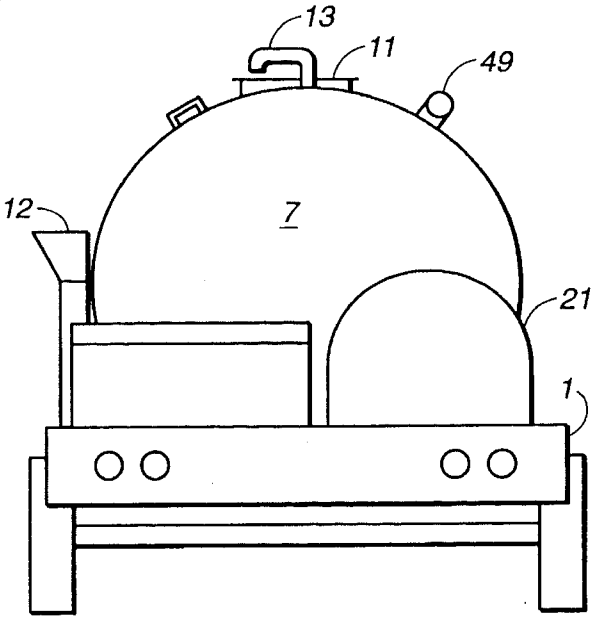
FIG. 2 is a rear elevational view of the portable apparatus of FIG. 1.

Referring to the drawings, FIG. 1 shows the portable apparatus of the present invention. The apparatus includes a wheeled vehicle, such as a trailer 1, a truck, a tractor, a railroad car, etc. The trailer 1 is of conventional design with a goose-neck trailer connection for connecting with a truck.

On the trailer 1 are mounted two water tanks 3,5 and two waste tanks 7,9. The water tanks 3,5 form a reservoir for the storage of water used to clean a sub-surface electrical enclosure. Each tank 3,5 may hold from 150 to 1500 gallons of water or more, depending on the capacity of the apparatus. The two waste tanks 7,9 are of similar size and configuration and form a reservoir for the storage and transportation of debris cleaned out of the sub-surface electrical enclosure.

Each tank 3,5,7,9 can have an opening and a lid 11 in the top for filling or cleaning each of the respective tanks and an emptying valve 10. In addition, the tanks 3,5,7,9 can be translucent or include one or more sight gauges for indicating the level of water or waste in the tanks. Man walk 12 provides easy and safe access to the openings in the top of each of the tanks. Vents 13 can be provided in the top of each waste tank 7,9 to reduce any back pressure that may cause a loss of efficiency to the suction pump and to prevent the build-up of dangerous or harmful gases if the apparatus is used to clean up hazardous materials.

Figure 4:
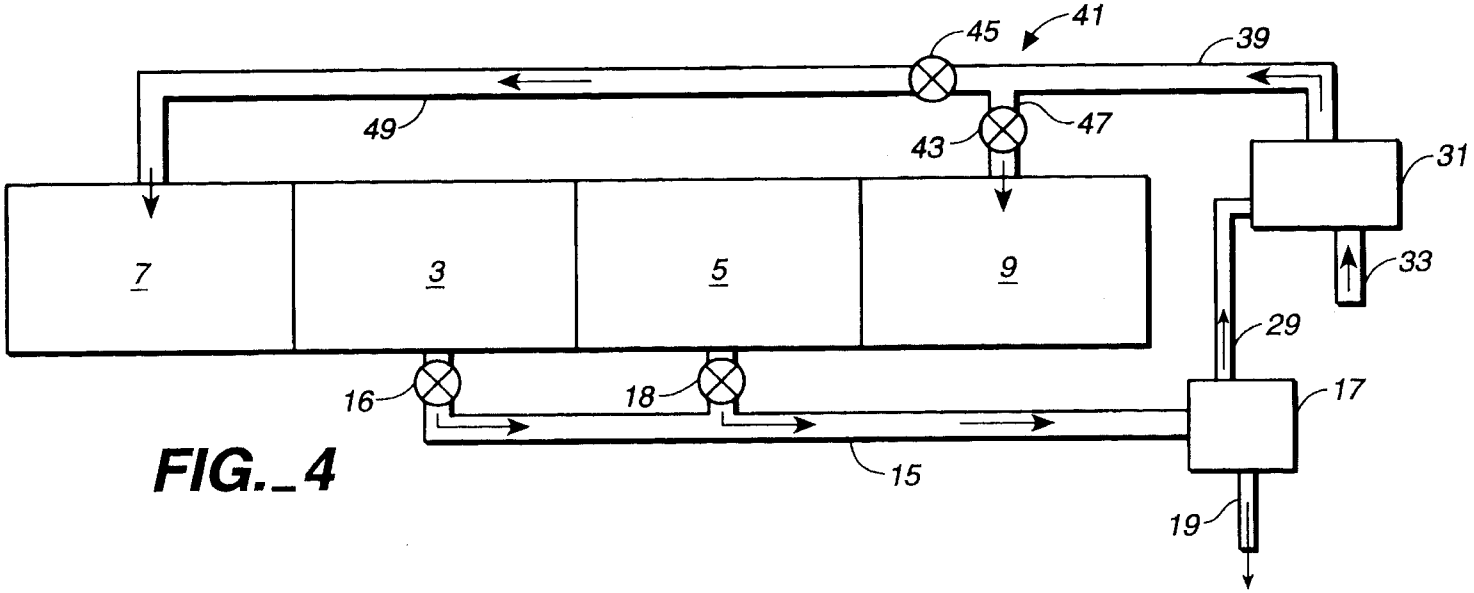
FIG. 4 is a schematic diagram of the valve and piping system in accordance with the present invention.

The valve and piping system is made of several components and is shown diagrammatically in FIG. 4. The components include a water supply line 15 connected to tanks 3,5 by a suitable means such as feed valves 16,18. The feed valve 16,18 can be any conventional valve such as ball valves, gate valves, etc. Branch 14 can be supplied for connecting feed valve 18 to water supply line 15. The water supply line 15 extends along the bottom of the tanks 3,5,9 to a water pump 17 which may be a conventional high pressure suction pump. Preferably, the output of the water pump 17 is 150 psi or greater.

Figure 3:
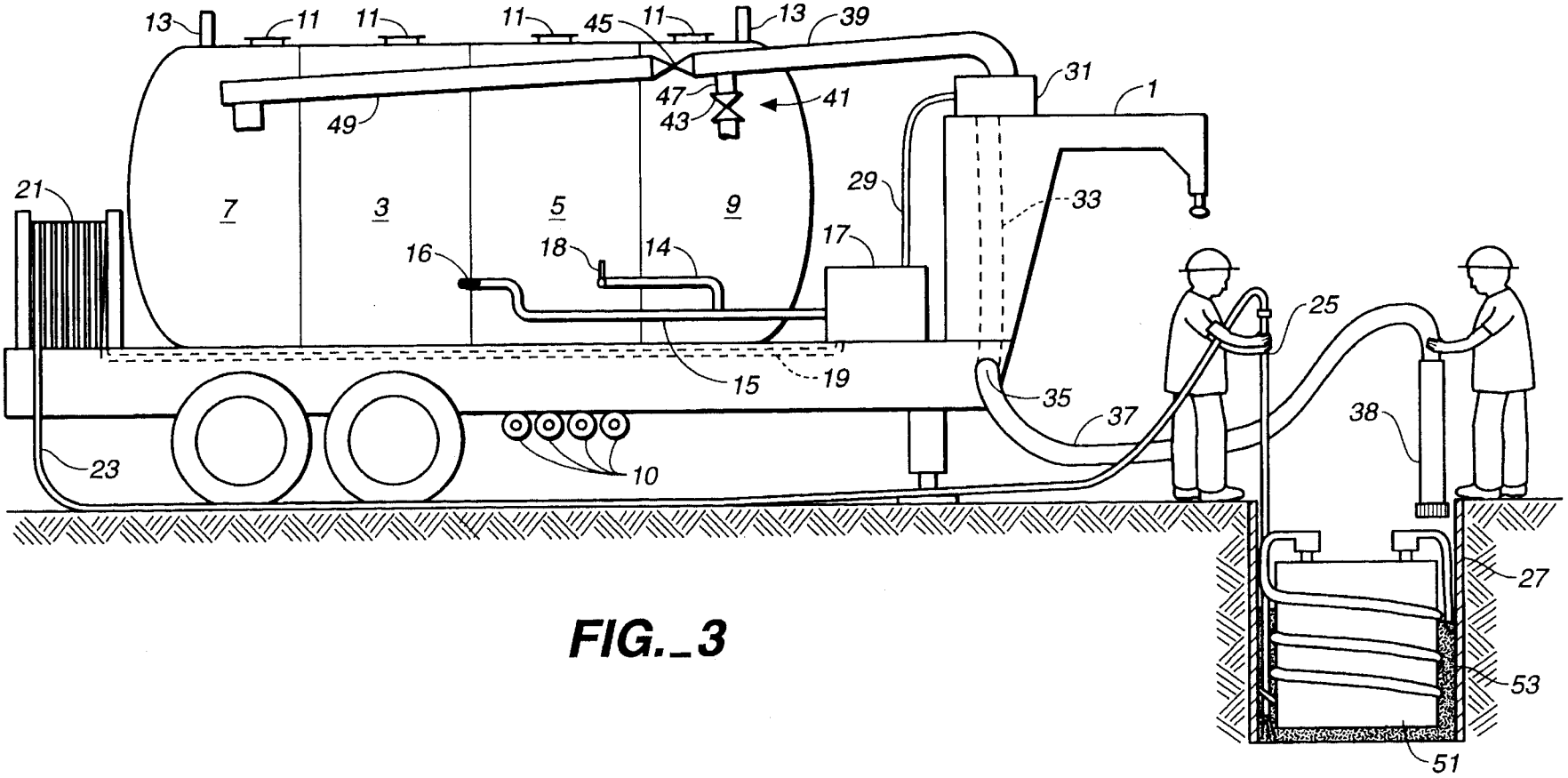
FIG. 3 is a side elevational view of the portable apparatus in the operation of cleaning a sub-surface electrical enclosure.

A connecting line 19 leads from the outlet of the water pump 17 to a hose reel 21 mounted on the rear of the trailer 1. The hose reel 21 is used for the storage of the hose 23 which is connected to a high pressure cleaning device 25 used for loosening and semi-liquefying waste, debris, sand, dirt, and other solids in the sub-surface enclosure 27 (FIG. 3). In operation, the water pump 17 produces a high pressure water flow to the cleaning device 25 through the hose 23 when either or both feed valves 16,18 are open. The cleaning device 25 should be long enough to extend from the bottom of the sub-surface enclosure 27 (typically, 5 to 7 feet deep) to a point above the enclosure which gives the operator a comfortable position in which to work and a safe working distance from the electrical equipment in case of an accident.

In one embodiment, the cleaning device 25 is a high pressure water jetting attachment that can be used in a safe manner in an electrical enclosure 27 that is still energized. In this embodiment, the hose 23 is a 1 inch flexible hose and the jetting attachment is made from a 0.5 inch schedule 80 polyvinylchloride (PVC) pipe because of its non-conductive properties. The cleaning device 25 is approximately 10 feet long and is reduced in size to 0.25 inches at the discharge end to increase the penetrating capabilities of the cleaning device 25. The high pressure, low flow rate cleaning device of the present invention reduces the amount of water used to clean the enclosure 27 by about 75% over existing methods.

A priming line 29 can be provided to connect the water pump 17 to the suction pump 31. Priming line 29 provides water to prime the suction pump 31. In addition, the priming line 29 can be used to provide high pressure water to the suction pump 31 to help force material through the suction pump 31 and to facilitate cleaning. A valve can be located on the priming line 29 to regulate the amount of water sent to the suction pump 31.

Preferably, suction pump 31 is a positive displacement diaphragm pump capable of producing twenty five feet of lift through a 3 inch suction hose 37 but can be any pump that is designed to move heavy materials with a minimum amount of water. It is advantageous to have the suction pump 31 mounted high on the trailer to reduce any unnecessary head pressure on the discharge side of the pump 31.

Suction pump 31 is connected on the inlet side to an inlet line 33. Inlet line 33 has an inlet connector 35 for receiving suction hose 37 (FIG. 3). Preferably, inlet line 33 and suction hose 37 are 3 inch diameter flexible hoses. The inlet connector 35 is mounted low on the trailer 1 so as to require minimal limiting of the suction hose 37 by the operator. Suction hose 37 can be lowered into the enclosure 27 or connected at its far end to a suction device 38 that is lowered into the enclosure 27 to extract the loosened and semi-liquified waste, debris, sand, dirt, and other solids in the sub-surface enclosure 27.

Preferably, the suction device 38 is made of non-conductive materials such as 3 inch, schedule 80 polyvinylchloride (PVC) pipe because of its strength and safety for working around electrically energized equipment in the enclosure. Various sized devices can be used depending on the requirements of the enclosure. For example, a 2 inch suction device made of the same material can be used in enclosures having more restricted space. In addition, the suction device 38 can be lengthened or shortened either telescopically or by adding or removing extension sections so as to accommodate the required depth of the enclosure being cleaned. A screening device can be added to the end of the suction device 38 to prevent large objects or debris from damaging the suction pump 31. The means for driving the water pump 17 and suction pump 31 are preferably internal combustion engines attached to each of the pumps. However, other means can be used to operate the pumps as will be recognized by one of ordinary skill in the art.

Suction pump 31 is connected on the outlet side to discharge line 39 for directing the waste, debris, sand, dirt, oil, paint, and other liquids and solids removed from the enclosure 27 to a waste liquid selection inlet valve or manifold type valve configuration, shown generally at 41. With the use of a diaphragm pump in line with the suction hose 37 and discharge line 39 as the suction pump 31, there is no need to create a vacuum in the waste tanks 7,9.

In one embodiment, the valve configuration 41 comprises two waste inlet valves 43,45 in fluid communication with waste tanks 7,9 through waste lines 47,49, respectively. The discharge line 39 and waste line 49 are sloped from the front of the trailer 1 toward the rear of the trailer to facilitate the movement of waste material into the appropriate waste tank and to prevent the lines from becoming plugged up with waste, debris, sand, dirt, etc. The discharge line 39 and waste line 49 can be provided with brackets spaced along their length to prevent over-flexing of the line, if necessary.

In operation, lids 11 are removed .from the cleaning apparatus and the water tanks 3,5 are filled with water or a mixture of water and a cleaning agent (e.g., a biodegradable degreaser) that is useful in cleaning up oily substances that may in an enclosure. If desired, one tank can be filled with water and the other tank can be filled with the water/cleaning agent mixture. The cleaning apparatus is then transported to a desired site to clean a selected sub-surface electrical enclosure. The enclosure 27 shown in FIG. 3 has a transformer 51 in it but the electrical device could be any of a variety of devices, such as switchers, relays, interrupters, J-boxes, terminal connections, splice boxes, etc.

Once on site (FIG. 3), soil/debris samples should be taken from the enclosure 27 to determine if the debris 53 is contaminated with hazardous materials. Then the hose 23 is unrolled from the hose reel 21 and the cleaning device 25 is connected to the hose 23. The suction hose 37 is connected on one end to the suction inlet 35 and on the other end to the suction device 38. Before starting the water pump 17, either or both of the feed valves 16,18 must be opened to supply water to the pump. In FIG. 3, feed valve 16 connected to tank 3 is open and feed valve 18 connected to tank 5 is closed. If tank 3 becomes empty during use, then feed valve 18 can be opened to supply water to the pump 17.

After opening one or both of the feed valves 16,18, the water pump 17 should be started and the cleaning device 25 should be placed in the enclosure to clean the transformer 51 or the like. If the enclosure 27 is filled or semi-filled with debris 53 (i.e., dirt, sand, leaves, oil, etc.) as shown in FIG. 3, then the cleaning device 25 should be used to cut down into the debris 53 until the debris is semi-liquified or a slurry forms in the enclosure 27. Prior art methods consist of washing the surface of the debris with a flood of water from a large hose to loosen it up, then removing the top layer of loosened debris with a suction hose. After that layer was removed, the method would continue layer by layer down to the bottom of the enclosure.

Cleaning device 25 can be pushed to the bottom of the debris to semi-liquify it from the bottom to the top. By jetting at the bottom of the debris 53, a minimal amount of moisture is injected into the enclosure 27 to form the slurry consistency. There is no splashing from a large water hose. The cleaning device 25 allows the operator to get in around the cables and equipment safely with the equipment still electrically energized without using a tremendous amount of water. Preferably, the slurry is kept fairly solid so that the suction pump 31 can move it but yet a minimal amount of water is used and a minimal amount of waste is produced.

Once the slurry is formed, either or both waste inlet valves 43,45 are opened. Preferably, waste inlet valve 45 is opened first and inlet valve 43 is closed so that waste tank 7 is filled first to provide even weight distribution to the trailer 1. After one or both of the waste inlet valves are opened, the suction pump 31 should be started. The suction device 38 should be lowered into the enclosure and preferably completely submerged to remove the debris, water, oil, waste, etc. The suction device 38 will remove the debris 53 as soon as there is enough moisture content in the debris. Preferably, the water jetting procedure with the cleaning device 25 is maintained while removing the debris and waste so as to help maintain a slurry. The cleaning device 25 can be used to scour the walls of the enclosure 27 after the debris 53 has been removed, but care should be taken so that the electrical component in the enclosure is not damaged. If waste tank 7 becomes full, waste inlet valve 43 should be opened first, then inlet valve 45 should be closed. This will prevent damage to the suction pump 31.

After the enclosure 27 is cleaned, the suction pump 31 should be turned off and the clean-out procedure started. The suction device 38 should be removed from the suction hose 37 and replaced with a clean-out attachment (not shown). The cleaning device 25 should be disconnected from the hose 23 and the end of hose 23 should be attached to the clean-out attachment. Either or both of the feed valves 16,18 should be open and the water pump 17 should be turned on. The suction pump 31 should be started and run until the suction hose 37, suction pump 31, discharge line 39, inlet valve 43 and/or 45 and waste line 47 and/or 49 are flushed clean and free of debris and waste materials. After the clean-out procedure is complete, the pumps 17,31 are turned off, the components are disassembled and stored for later use. The cleaning apparatus can then be transported to a selected disposal site and the debris, waste, water, etc. in waste tanks 7 and/or 9 can be disposed of properly through the emptying valves 10.

If the enclosure 27 is contaminated with a hazardous material. One tank of the apparatus can be loaded with water and the other loaded with the cleaning agent/water mixture. The cleaning agent/water mixture can be used to do the preliminary wash down and cleanup. The water can be used as a rinse.

The valve configuration 41 has been found to be very advantageous in operation for a number of reasons. The valve configuration is such that the piping associated with tank 7 can be isolated from the piping associated with tank 9 and vice versa. Likewise, clean water in tanks 3,5 can not be mixed with waste materials removed from an enclosure. In one embodiment, waste inlet valve 45 is perpendicular to and downstream of waste inlet valve 43 (FIG. 4). Preferably, waste inlet valve 45 is located relatively near to the junction of discharge line 39 and waste line 47. With this configuration, the waste inlet valve 43 can be closed and the waste, debris, etc. is directed through inlet valve 45 to the waste tank 7. In this way, if the waste that is being removed from the enclosure 27 is hazardous (or if it is unknown whether it is hazardous), none of the waste can contaminate waste tank 9. With the high pressure cleaning system, the discharge line 39, the waste inlet valve 45, the waste line 49, and in particular the waste line 47 and inlet side of the waste inlet valve 43 can be cleaned without the possibility of contamination reaching waste tank 9.

The best advantage is realized when the waste inlet valves 43,45 are mounted close together. It is has been discovered that with this configuration, the swirling effect of water going by the waste line 47 will clean waste line 47 and the inlet side of inlet valve 43 very effectively.

In addition, after a site and the apparatus have been cleaned, the cleaning apparatus can be moved to another site. The waste inlet valve 45 is closed. Waste inlet valve 43 is opened. Waste extracted from the new enclosure hits the closed inlet valve 45 and is directed through the inlet valve 43 into waste tank 9. The same swirling effect occurs on the inlet side of inlet valve 45 as the apparatus is cleaned after use as occurs when inlet valve 43 is closed. With this configuration, there is no contamination of waste line 49.

With the valve configuration 41 of the present invention, an operator can be cleaning an enclosure 27 that is known to have hazardous material in it and get an emergency response call for a failed transformer that may or may not have leaked hazardous material into its enclosure. The operator can respond to the emergency without having to unload the tank containing the hazardous material and store the waste generated at the emergency site in the other remaining empty tank. There is no cross-contamination of the waste materials or the discharge and waste lines of the apparatus.

Figure 5D:
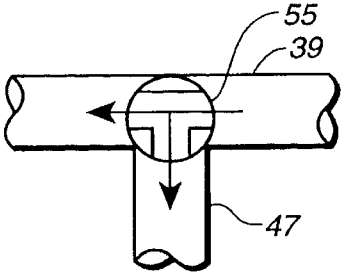
FIGS. 5A–5D are schematic diagrams of an alternate embodiment for part of the valve system of the present invention.
Figure 5C:
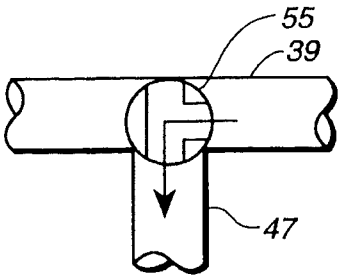
Figure 5B:
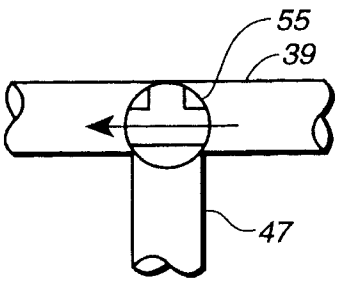
Figure 5A:
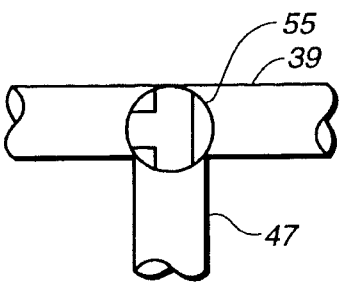

An alternative embodiment for the valve configuration 41 is shown in FIGS. 5A–5D. The two- valve configuration 41 can be replaced with a four position diverter valve 55 placed at the junction between discharge line 39 and waste line 47. In FIG. 5A, the diverter valve 55 is closed and no waste can pass to either tanks 7,9. In FIG. 5B, diverter valve 55 is in a second position in which waste can only pass to tank 7. In FIG. 5C, diverter valve 55 is in a third position in which waste can only pass to tank 9. In FIG. 5D, diverter valve 55 is in a fourth position in which waste can pass to both tanks 7,9. The diverter valve 55 has the same advantages as discussed above in that one of the tanks 7,9 can be isolated so that no contamination reaches the other tank.

As will be appreciated by one of ordinary skill in the art, although the present invention has been described as operating with two water tanks and two waste tanks, any combination of numbers of tanks can be used including only one water tank and one waste tank or one water tank and two waste tanks, three water tanks and two wast tanks, and so on.

It will now be apparent to those skilled in the art that various modifications, variations, substitutions, and equivalents exist for various elements of the invention but which do not materially depart from the spirit and scope of the invention. Accordingly, it is expressly intended that all such modifications, variations, substitutions, and equivalents which fall within the spirit and scope of the invention as defined by the appended claims be embraced thereby.

What is claimed is:

1. A method for cleaning liquids and solids from a sub-surface electrical enclosure that may have hazardous materials present, comprising:

opening a water feed valve attached to a water tank for supplying water to a water pump to clean the sub-surface electrical enclosure;

attaching a high pressure cleaning device to the water pump;

starting the water pump;

semi-liquefying the solids in the sub-surface electrical enclosure with the high pressure cleaning device to form a slurry;

attaching a suction hose to a suction pump to draw the liquids and solids from the sub-surface electrical enclosure;

opening a first waste inlet valve in fluid communication with a first waste tank so that liquids and solids can be received in the first waste tank;

starting the suction pump;

suctioning the liquids and solids from the sub-surface electrical enclosure through the suction hose to the first waste tank;

stopping the water pump and the suction pump when the liquids and solids have been removed from the sub-surface electrical enclosure;

attaching a clean-out attachment to the suction hose to flush the suction hose, the suction pump, and the first waste inlet valve;

connecting the high pressure cleaning device to the clean-out attachment; and running the water pump and the suction pump until the suction hose, the suction pump, and the first waste inlet valve are clean of the liquids and solids.

2. The method of claim 1 further comprising:

opening a second waste inlet valve in fluid communication with a second waste tank so that liquids and solids can be received in the second waste tank;

closing the first waste inlet valve;

suctioning the liquid and solids from the sub-surface electrical enclosure to the second waste liquid tank; and cleaning the second waste inlet valve along with the suction hose and the suction pump through the clean-out attachment.

3. The method of claim 2, further comprising:

closing the second waste inlet valve;

opening the first waste inlet valve; and cleaning the first waste inlet valve along with the suction hose and the suction pump through the clean-out attachment.

* * * * *